US011566546B2

(12) United States Patent
Higashiyama et al.

(10) Patent No.: US 11,566,546 B2
(45) Date of Patent: Jan. 31, 2023

(54) EXHAUST MUFFLER STRUCTURE

(71) Applicant: HONDA MOTOR CO., LTD., Tokyo (JP)

(72) Inventors: Junji Higashiyama, Saitama (JP); Ryosuke Kinoshita, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 502 days.

(21) Appl. No.: 16/691,538

(22) Filed: Nov. 21, 2019

(65) Prior Publication Data

US 2020/0263578 A1 Aug. 20, 2020

(30) Foreign Application Priority Data

Feb. 19, 2019 (JP) ..... JP2019-027018

(51) Int. Cl.

| | |
|---|---|
| ***F01N 1/02*** | (2006.01) |
| ***F01N 13/18*** | (2010.01) |
| ***F01N 3/00*** | (2006.01) |
| ***F01N 3/28*** | (2006.01) |
| ***F01N 1/08*** | (2006.01) |

(52) U.S. Cl.

CPC ..... *F01N 1/02* (2013.01); *F01N 1/085* (2013.01); *F01N 3/2885* (2013.01); *F01N 13/1838* (2013.01); *F01N 2230/04* (2013.01); *F01N 2450/22* (2013.01); *F01N 2590/00* (2013.01)

(58) Field of Classification Search

CPC ... F01N 1/02; F01N 1/085; F01N 1/08; F01N 1/081; F01N 1/082; F01N 3/2885; F01N 3/24; F01N 3/28; F01N 3/2882; F01N 3/2839; F01N 3/2878; F01N 13/18; F01N 13/1838; F01N 2230/04; F01N 2450/22; F01N 2590/00

See application file for complete search history.

(56) References Cited

U.S. PATENT DOCUMENTS

| | | | | |
|---|---|---|---|---|
| 7,273,592 | B2 * | 9/2007 | Jacob | F01N 13/1894 60/299 |
| 8,359,835 | B2 * | 1/2013 | Nishimura | F01N 3/2885 181/269 |
| 8,701,824 | B2 * | 4/2014 | Hayama | F01N 3/2885 181/269 |

(Continued)

FOREIGN PATENT DOCUMENTS

| | | | | |
|---|---|---|---|---|
| CN | 107965363 | A * | 4/2018 | |
| EP | 2573339 | B1 * | 9/2014 | F01N 1/08 |

(Continued)

*Primary Examiner* — Edgardo San Martin

(57) ABSTRACT

An exhaust muffler structure to which an exhaust pipe for guiding exhaust gas from an engine to an exhaust muffler is connected, the exhaust muffler structure comprising a catalyst device, included inside the exhaust muffler structure, having a catalyst for purifying the exhaust gas of the engine, wherein the catalyst device has one end connected to the exhaust pipe and is supported inside the exhaust muffler via the exhaust pipe, and a body portion of the catalyst device is supported by a first partition wall having an inner partition wall and an outer partition wall that is on the outer side of the inner partition wall, and the outer partition wall is fixed to the inner wall of the exhaust muffler, and the inner partition wall is fixed to the outer wall of the catalyst device.

10 Claims, 7 Drawing Sheets

(56) References Cited

U.S. PATENT DOCUMENTS

| | | | | |
|---|---|---|---|---|
| 9,289,723 | B2 * | 3/2016 | Kobayashi | F01N 13/0093 |
| 11,267,333 | B2 * | 3/2022 | Konno | F01N 3/24 |
| 2013/0075192 | A1 | 3/2013 | Hayama | |
| 2017/0089303 | A1 | 3/2017 | Kurata | |
| 2021/0199034 | A1 * | 7/2021 | Murakami | F01N 1/084 |

FOREIGN PATENT DOCUMENTS

| | | | | | |
|---|---|---|---|---|---|
| JP | H05340233 | A | * | 12/1993 | |
| JP | 2004353635 | A | * | 12/2004 | F01N 13/1838 |
| JP | 2008025560 | A | * | 2/2008 | F01N 1/006 |
| JP | 2008303787 | A | * | 12/2008 | |
| JP | 5828390 | B2 | | 12/2015 | |
| JP | 6044535 | B2 | * | 12/2016 | F01N 13/009 |
| JP | 6145486 | B2 | | 6/2017 | |
| JP | 2019027297 | A | * | 2/2019 | |
| WO | WO-9418441 | A1 | * | 8/1994 | F01N 3/2842 |

* cited by examiner

EXHAUST MUFFLER STRUCTURE

The contents of the following Japanese patent application are incorporated herein by reference:
2019-027018 filed on Feb. 19, 2019.

BACKGROUND

1. Technical Field

The present invention relates to an exhaust muffler structure.

2. Related Art

There is known a muffler for a small-size vehicle that is connected to an exhaust pipe connected to an engine and has a catalyst inside (for example, see PTL 1 below). In addition, there is known a straddle type vehicle including a pair of left and right front wheels and rear wheels (for example, refer to PTL 2 below).

PRIOR ART DOCUMENTS

Patent Documents

PTL 1: Japanese Patent No. 5828390
PTL 2: Japanese Patent No. 6145486

DESCRIPTION OF EXEMPLARY EMBODIMENTS

Figure 1:
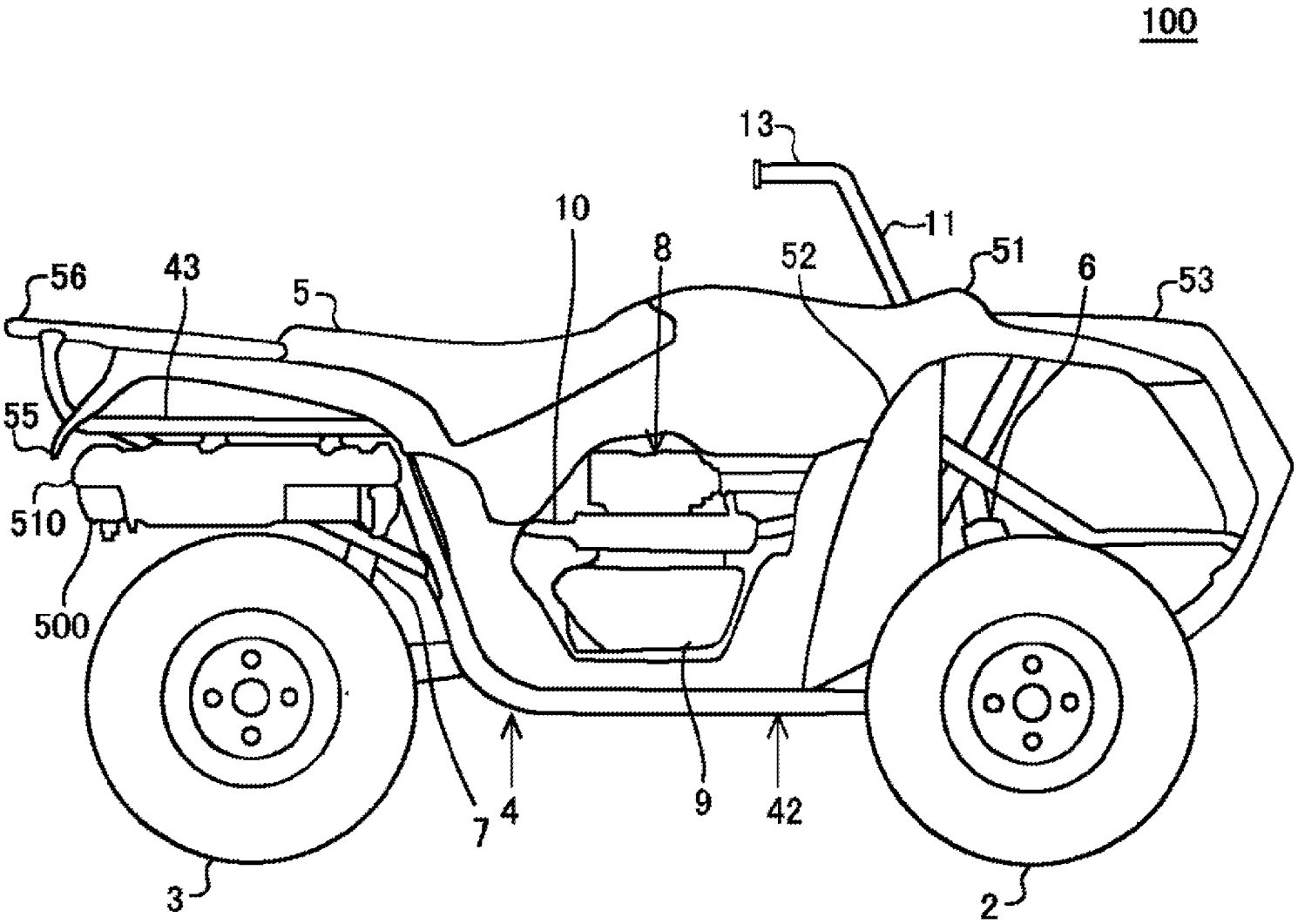
FIG. 1 is a side view diagram schematically showing a straddle type vehicle 100.

While the present invention will be described below through embodiments of the invention, the embodiments below shall not limit the invention according to the scope of the claims. In addition, not all the combinations of characteristics described in the embodiments are essential for the solution of the invention. It is noted that unless otherwise specified, components and the like denoted by the same reference numerals in the drawings have the same configuration and function.

FIG. 1 is a side view diagram schematically showing a straddle type vehicle 100. The straddle type vehicle 100 is a rough terrain vehicle called an ATV. The straddle type vehicle 100 has a relatively high minimum ground clearance mainly in order to improve its running performance on rough terrain. The straddle type vehicle 100 includes pairs of left and right front wheels 2 and rear wheels 3 on the front and rear of a relatively small and light vehicle body. The front wheels 2 and the rear wheels 3 are relatively large-diameter low-pressure balloon tires.

It is noted that in the present embodiment, the direction from the rear wheels 3 to the front wheels 2 is defined as the front direction, and the direction from the front wheels 2 to the rear wheels 3 is defined as the rear direction. When facing the front wheels 2 from the rear wheels 3, the left hand side is defined as the left and the right hand side is defined as the right. The direction toward the ground when the front wheels 2 and the rear wheels 3 of the straddle type vehicle 100 are in contact with the ground is defined as the downward direction, and the opposite direction of the downward direction is defined as the upward direction.

Figure 2:
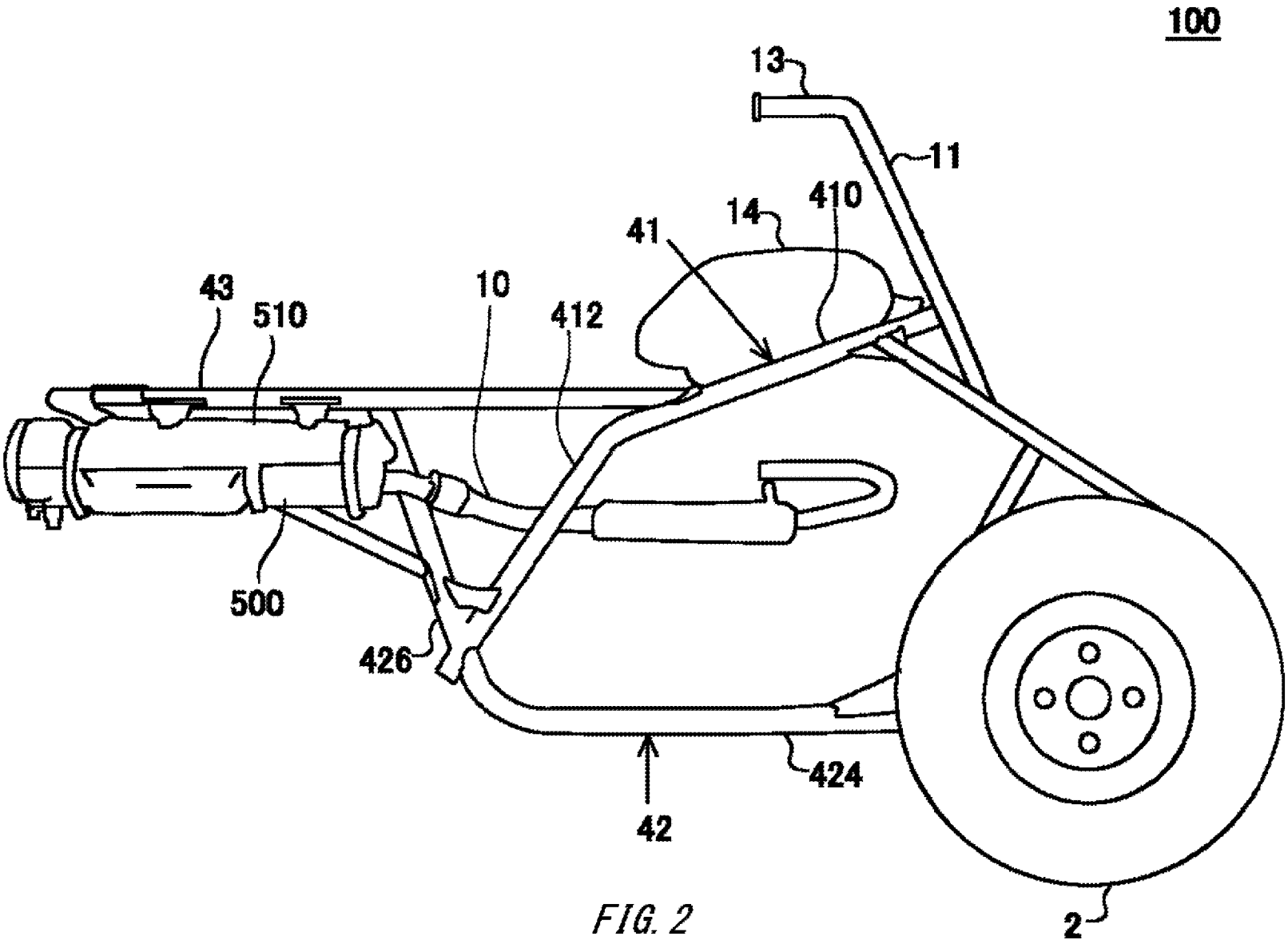
FIG. 2 is a partial side-view diagram of the straddle type vehicle 100 from which the vehicle body cover 51 and the engine 8 have been removed.

The straddle type vehicle 100 includes a metal vehicle body frame 4, a passenger seat 5, a vehicle body cover 51, and an engine 8. FIG. 2 is a partial side view diagram mainly showing the exhaust system of the straddle type vehicle 100 and attachment of the vehicle body frame 4. The vehicle body frame 4 is formed by integrally joining metal materials including a plurality of metal pipes by welding or the like. The vehicle body frame 4 has a shape extending substantially in the front-rear direction in order to support the front wheels 2, the rear wheels 3, and the like.

A pair of left and right independent suspension type front suspensions 6 are provided on the left and right of the front part of the vehicle body frame 4. The left and right front wheels 2 are suspended via the left and right front suspensions 6. A pair of left and right axle type rear suspensions 7 are provided on the left and right of the rear part of the vehicle body frame 4. The left and right rear wheels 3 are suspended via the left and right rear suspensions 7.

The vehicle body frame 4 includes a frame body including left and right upper pipes 41, left and right lower pipes 42, and a plurality of rear pipes 43. The vehicle body frame 4 has a pair of left and right frame bodies joined together via a plurality of cross members, thereby forming a box structure that is elongated in the front-rear direction at the center in the vehicle width direction.

Each upper pipe 41 includes an upper inclined portion 410 that extends slightly obliquely rearward and downward in the vehicle body front-rear direction, and a rear inclined portion 412 that extends obliquely rearward and downward from the rear end portion of the upper inclined portion 410 at a larger inclination angle. Each rear pipe 43 extends rearward from the connecting portion between the upper inclined portion 410 and the rear inclined portion 412 of the upper pipe 41 substantially horizontally in the front-rear direction, and is connected with a rear inclined portion 426 of the lower pipe 42 on its substantially middle portion in the front-rear direction. The lower pipe 42 includes the rear inclined portion 426 that is connected to the rear pipe 43 and the rear inclined portion 412 and extends obliquely forward and downward, and a lower horizontal portion 424 that extends rearward substantially horizontally in the front-rear direction from the lower end portion of the rear inclined portion 426.

A steering shaft 11 is supported at the center in the left-right direction of the front part of the vehicle body frame 4. A steering handlebar 13 is integrally attached to the upper portion of the steering shaft 11, and the front wheels 2 are steered left and right via the steering shaft 11 in response to the operation of the steering handlebar 13.

The front part of the vehicle body frame 4 is attached with the resin vehicle body cover 51 that covers the front part of the vehicle body from above, a resin front fender 52 that covers both front wheels 2 from above toward the rear, and a front protector 53 that covers the front side of vehicle body cover 51. The rear part of the vehicle body frame 4 is attached with a resin rear fender 55 that covers both rear wheels 3 from the front side to the upper side and a rear carrier 56 made mainly of steel.

A fuel tank 14 is disposed between the steering shaft 11 and the passenger seat 5. The fuel tank 14 is supported on the upper part of the vehicle body frame 4. Fuel inside the fuel tank 14 is supplied to the engine 8 by a fuel pump provided inside the fuel tank 14.

The engine 8 is disposed in the front and rear center of the vehicle body frame 4. The engine 8 is an internal combustion engine. The engine 8 is, for example, driven by fuel inside the fuel tank 14. The engine 8 is, for example, a water-cooled single cylinder engine.

A crank and a transmission are accommodated inside a case 9 that is provided at the lower part of the engine 8. The transmission inside the case 9 is connected to the propeller shafts for the front wheels and rear wheels, respectively, and the rotational driving force of the engine 8 is transmitted to the front wheels 2 and the rear wheels 3 through the propeller shafts. As a result, a four-wheel drive driving system in which the front wheels 2 and the rear wheels 3 are rotationally driven by the driving force of the engine 8 is configured. It is noted that the driving system of the straddle type vehicle 100 may include a driving system switching mechanism that makes it possible to switch to two-wheel drive that drives either the front wheels 2 or the rear wheels 3.

An exhaust pipe 10 is connected to the engine 8. The exhaust pipe 10 extends rearward from the engine 8 and is connected to an exhaust muffler 500. The exhaust muffler 500 is disposed to the rear of the vehicle body frame 4. Specifically, the exhaust muffler 500 is attached to the rear pipe 43. The exhaust gas of the engine 8 is discharged from the exhaust discharge port at the rear end of the exhaust muffler 500 through the exhaust pipe 10 and the exhaust muffler 500. The exhaust system of the engine 8 is configured by the exhaust pipe 10 and the exhaust muffler 500.

Figure 3:
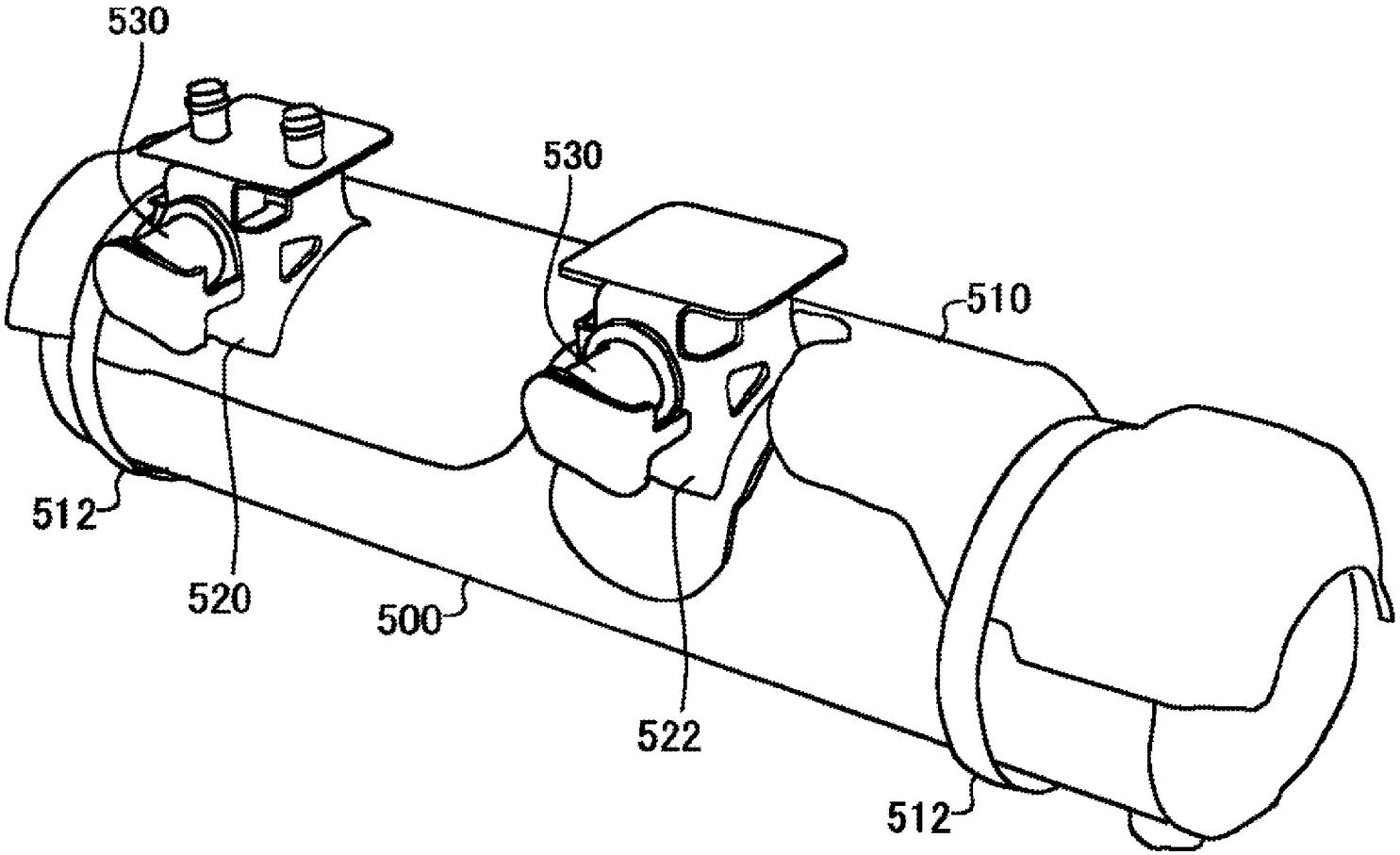
FIG. 3 is a perspective diagram showing the exhaust muffler 500.

FIG. 3 is a perspective diagram showing the exhaust muffler 500. The exhaust muffler 500 is attached with a muffler cover 510 that mainly covers the upper side of the exhaust muffler 500. The muffler cover 510 is attached to the exhaust muffler 500 by at least a substantially cylindrical band 512. The muffler cover 510 mainly suppresses the upward release of heat from the exhaust muffler 500. The muffler cover 510 is provided apart from the exhaust muffler 500 so that air flows between the muffler cover 510 and the exhaust muffler 500.

A muffler stay 520 and a muffler stay 522 are fixed to the outer peripheral surface of the exhaust muffler 500. The muffler stay 520 and the muffler stay 522 are welded to the outer peripheral surface of the exhaust muffler 500. The exhaust muffler 500 is attached to the rear pipe 43 via the muffler stay 520, the muffler stay 522, and cushioning 530.

Figure 4:
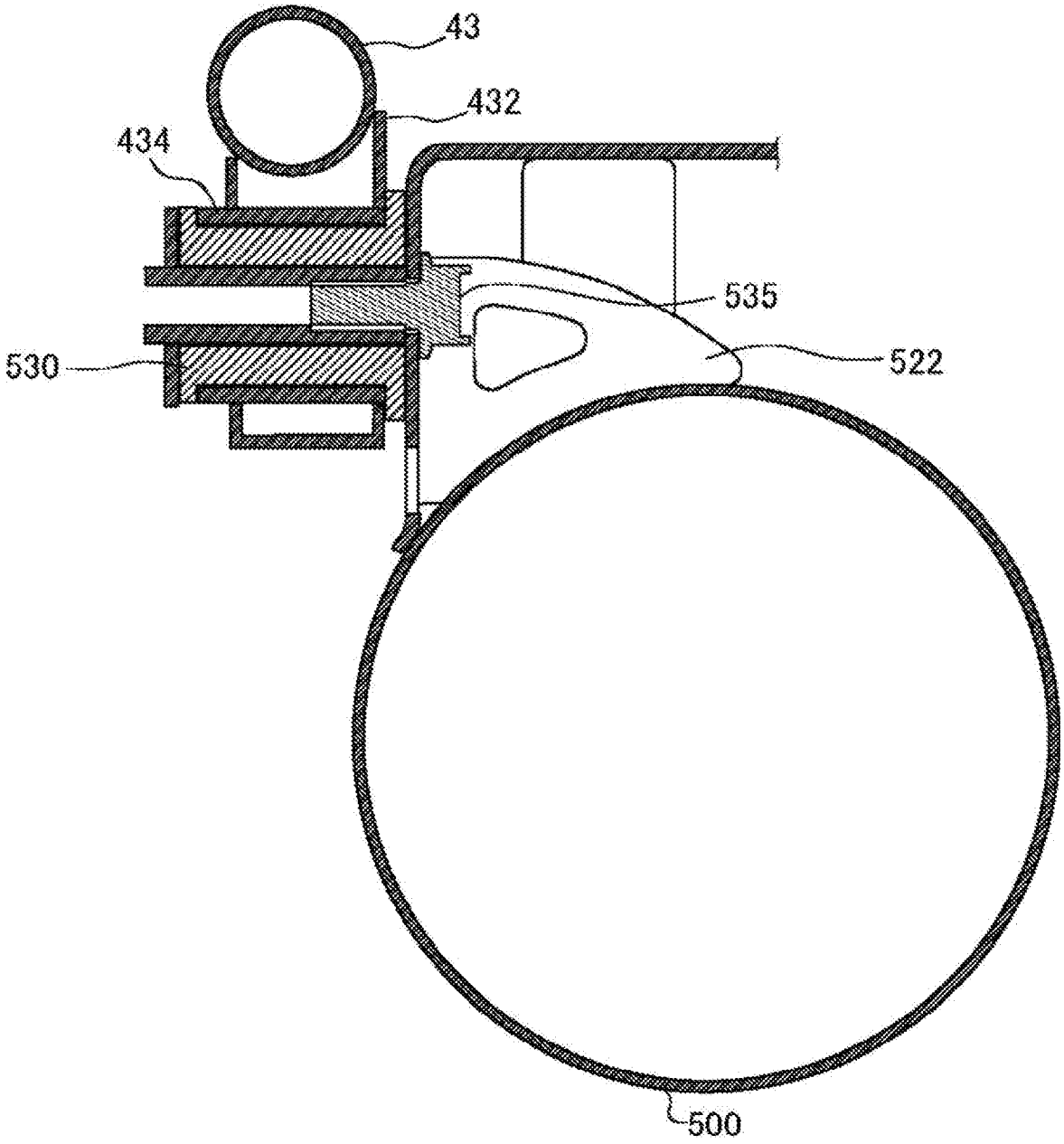
FIG. 4 is a cross-sectional diagram showing the muffler stay 522.

FIG. 4 is a cross-sectional perspective view showing an attachment portion of the exhaust muffler 500. A pipe stay 432 is joined to the rear pipe 43. The cushioning 530 is provided inside a collar 434 that is joined to the pipe stay 432. The cushioning 530 is formed of a rubber material and has a substantially cylindrical shape. The muffler stay 522 is attached to the pipe stay 432 via the cushioning 530 by a fastening member 535 that is inserted inside a through hole in the center of the cushioning 530. As a result, vibration generated in the exhaust muffler 500 can be made difficult to be transmitted to the rear pipe 43.

Figure 5:
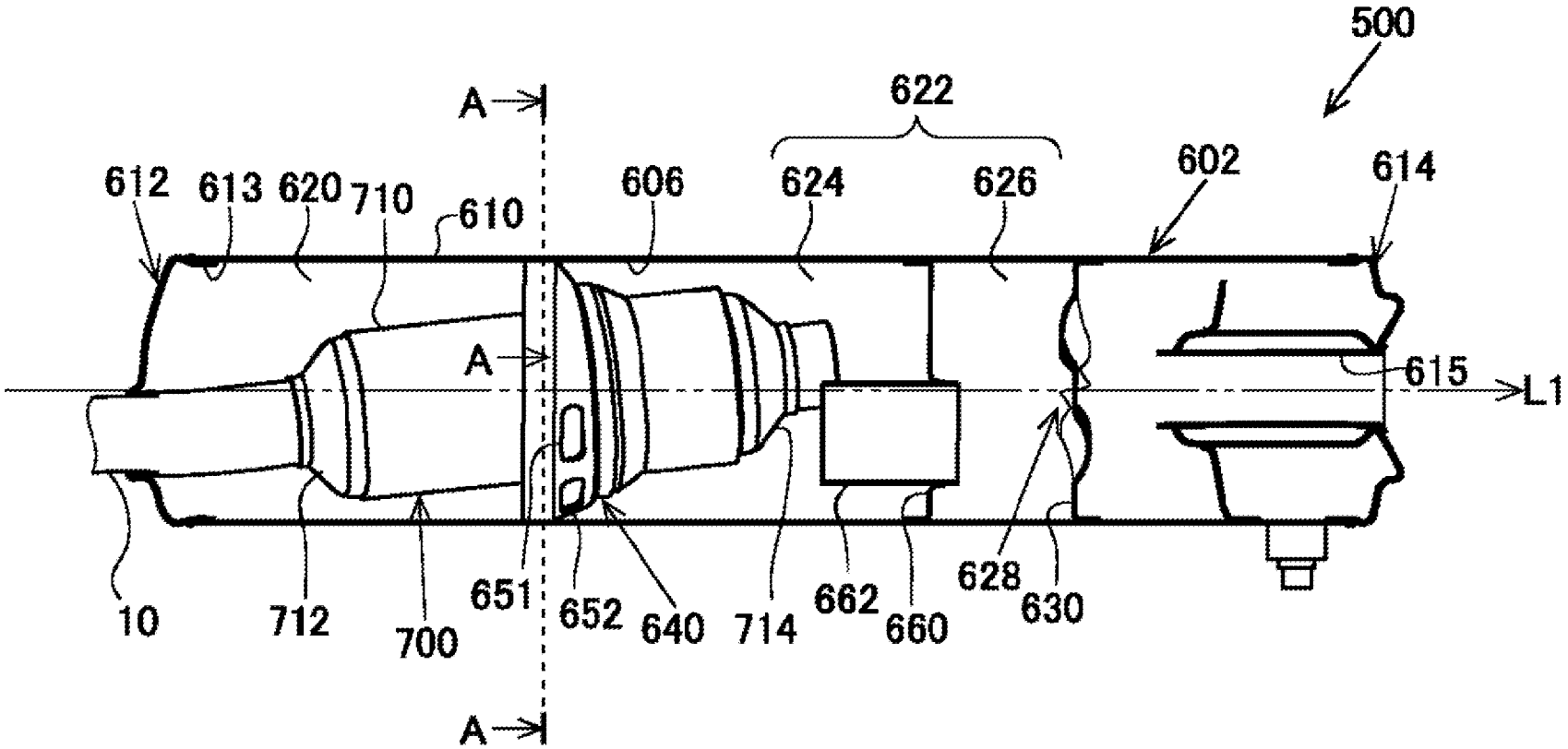
FIG. 5 is a cross-sectional perspective diagram schematically showing the structure of the exhaust muffler 500.
Figure 6:
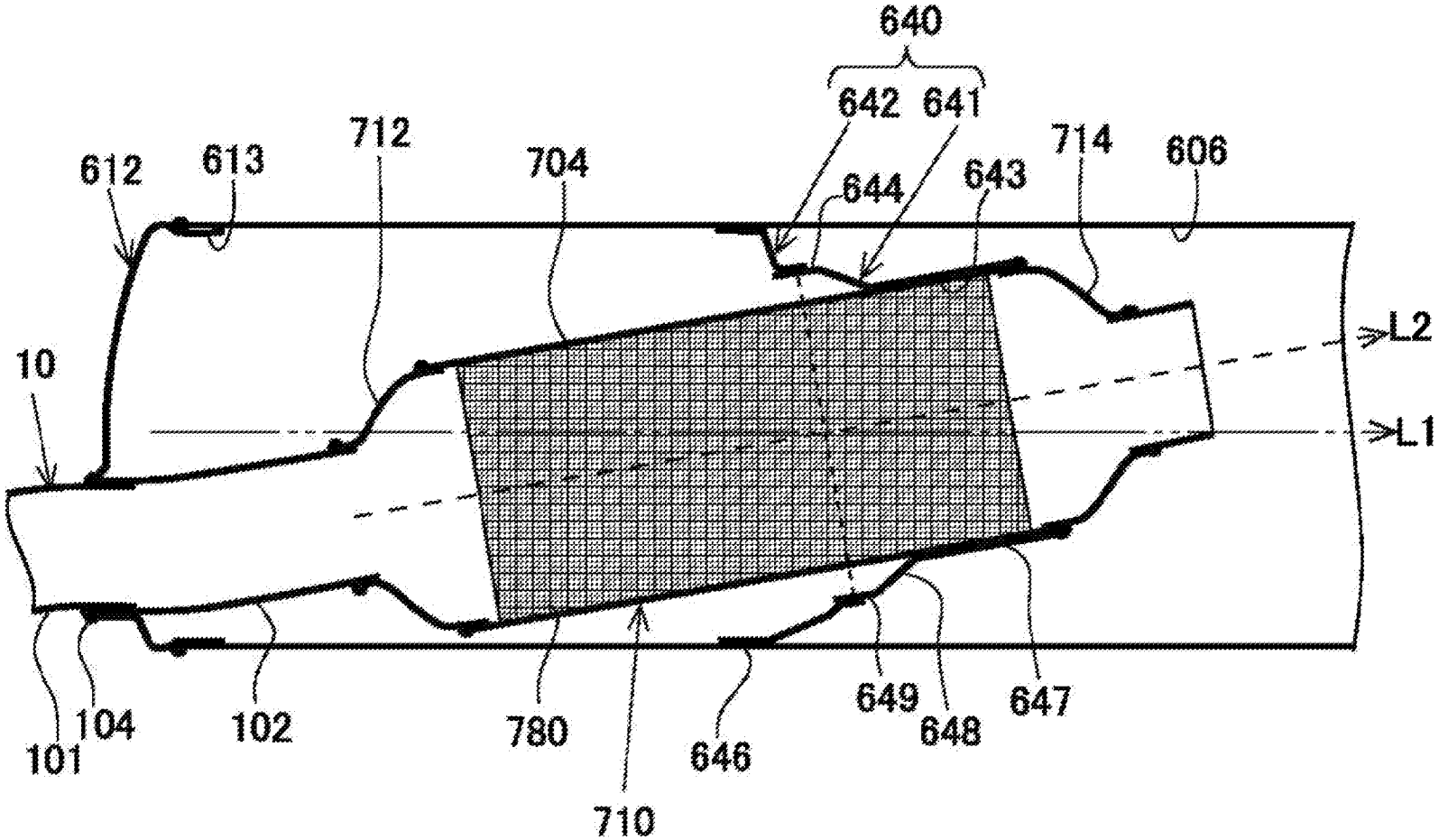
FIG. 6 is a partial cross-sectional diagram schematically showing the support structure of the catalyst device 700 inside the exhaust muffler 500.
Figure 7:
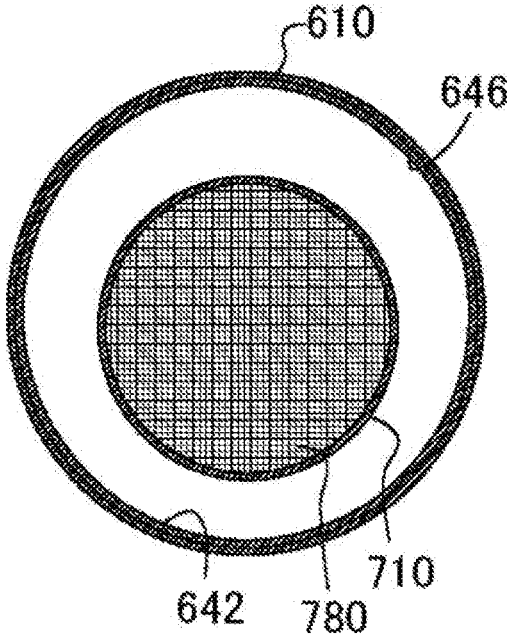
FIG. 7 is a cross-sectional diagram showing the cross section along the line AA of FIG. 5.

FIG. 5 is a cross-sectional perspective view schematically showing the structure of the exhaust muffler 500. FIG. 5 is a cross-sectional perspective view of the exhaust muffler 500 cut along a vertical plane including an axis L1 of the exhaust muffler 500 in a state where the exhaust muffler 500 is installed on the straddle type vehicle 100. FIG. 6 is a partial cross-sectional diagram schematically showing a support structure of a catalyst device 700 inside the exhaust muffler 500. FIG. 7 is a cross-sectional diagram of a cross-section taken along the line AA of FIG. 5.

The exhaust muffler 500 has an outer shell formed by the muffler body 602. The muffler body 602 is formed including a body portion 610, a front wall 612, and a rear wall 614. The body portion 610 is formed by winding a stainless steel outer plate in a cylindrical shape and butt welding the free ends of the outer plate to one another. The front wall 612 closes the front end of the body portion 610. The rear wall 614 closes the rear end of the body portion 610. The rear end of the exhaust pipe 10 is joined to the front wall 612. A discharge pipe 615 forming an exhaust discharge port that opens to the outside is joined to the rear wall 614.

The front wall 612 and the rear wall 614 are formed by stainless steel plates. The front wall 612 has a peripheral wall 613 joined to the front end of the body portion 610 by welding. Similarly, the rear wall 614 is joined to the rear end of the body portion 610 by welding.

The middle part in the front-rear direction of the inside the muffler body 602 is partitioned into a front gas chamber 620 and a rear gas chamber 622 by a first partition wall 640. The first partition wall 640 is fixed to the inner peripheral surface of the outer plate that forms an inner wall 606 of the body portion 610 of the muffler body 602. The rear gas chamber 622 is partitioned into a rear first gas chamber 624 and a rear second gas chamber 626 by a second partition wall 660 that is welded to the inner wall 606 of the body portion 610.

The catalyst device 700 is accommodated across the front gas chamber 620 and the rear first gas chamber 624. The catalyst device 700 is supported by at least the first partition wall 640.

A communication hole 651 and a communication hole 652 are formed through the first partition wall 640. In addition, a communication pipe 662 is provided through the second partition wall 660. The front gas chamber 620, the rear first gas chamber 624, and the rear second gas chamber 626 communicate with one another through the communication hole 651, the communication hole 652, and the communication pipe 662. As a result, it is possible for the front gas chamber 620, the rear first gas chamber 624, and the rear second gas chamber 626 to function substantially as a single gas chamber.

The rear second gas chamber 626 is provided with a partition wall 630 having a wave-like portion 628. The wave-like portion 628 generates vortex flows in various directions in the exhaust gas passing through the wave-like portion 628. The discharge pipe 615 is provided further to the rear than the partition wall 630 in the rear second gas chamber 626.

The catalyst device 700 has a substantially cylindrical shape. The catalyst device 700 includes a body portion 710, an enlarged cylinder portion 712, and a throttle cylinder portion 714. The enlarged cylinder portion 712 of the catalyst device 700 is an example of a front wall provided at the front part of the body portion 710. The enlarged cylinder portion 712 has a rear end joined to the front end of the body portion 710 by welding and a front end joined to the exhaust pipe 10 by welding. The body portion 710, the enlarged cylinder portion 712, and the throttle cylinder portion 714 of the catalyst device 700 are formed of stainless steel plates.

The throttle cylinder portion 714 is an example of a rear wall provided at the rear portion of the body portion 710. The front end of the throttle cylinder portion 714 is joined to the rear end of the body portion 710 by welding. The rear end of the throttle cylinder portion 714 opens into the rear first gas chamber 624. The exhaust gas flowing into the catalyst device 700 from the exhaust pipe 10 is purified by the catalyst device 700 and flows into the rear first gas chamber 624.

The catalyst device 700 includes a catalyst 780. The catalyst 780 is a metal catalyst supported on a metallic carrier. The metallic carrier is accommodated in the cylindrical body portion 710. The metallic carrier is processed into a honeycomb-type cylinder by bending a metal plate. The catalyst is, for example, a metal catalyst such as platinum, rhodium, or palladium.

The exhaust gas generated by the operation of the engine 8 is guided into the exhaust muffler 500 through the exhaust pipe 10. The exhaust gas that has been guided inside the exhaust muffler 500 flows into the catalyst device 700. The exhaust gas is purified of harmful components such as HC, CO, and $NO_x$ by the catalyst 780 inside the catalyst device 700 and flows into the rear first gas chamber 624 of the exhaust muffler 500 through the catalyst device 700.

The exhaust gas that has flowed into the rear first gas chamber 624 flows into the rear second gas chamber 626 through the communication pipe 662. The exhaust gas that has flowed into the rear second gas chamber 626 passes through the wave-like portion 628. The wave-like portion 628 generates vortex flows in various directions in the exhaust gas passing through the wave-like portion 628. The silencing effect is enhanced by the interference of the vortex flows of the exhaust gas that are generated by the wave-like portion 628. The exhaust gas that has passed through the wave-like portion 628 passes through the discharge pipe 615 and is discharged to the outside.

It is noted that the exhaust muffler 500 becomes hot due to the reaction heat in the catalyst device 700 in addition to the heat of the exhaust gas discharged from the engine 8. For this reason, heat is radiated from the exhaust muffler 500. Heat that radiates upward from the exhaust muffler 500 is blocked by the muffler cover 510. As a result, since it is possible to suppress the radiation of heat toward the passenger seat 5, it is possible to suppress the rise of temperature near the passenger seat 5.

Next, a further description is given of the support structure of the catalyst device 700 inside the exhaust muffler 500. The catalyst device 700 is supported by the first partition wall 640 and the front wall 612 so as to be inclined rearward and upward inside the muffler body 602. An axis L2 of the catalyst device 700 intersects the axis L1 of the muffler body 602. This makes it possible to accommodate a longer catalyst device 700. For this reason, it is possible to improve the exhaust gas purification performance.

The first partition wall 640 includes an inner partition wall 641 and an outer partition wall 642. The inner partition wall 641 and the outer partition wall 642 are formed of stainless steel plates.

Figure 8:
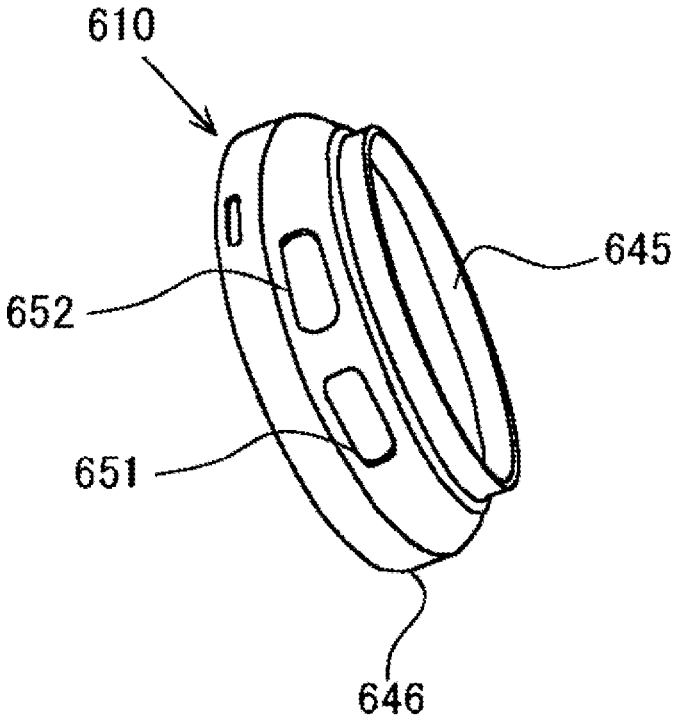
FIG. 8 is a perspective diagram showing the outer appearance of the outer partition wall 642.

An inner surface 643 of the inner partition wall 641 is the inner surface of the first partition wall 640. The inner surface 643 of the inner partition wall 641 is joined to an outer wall 704 of the body portion 710 of the catalyst device 700 by welding. FIG. 8 is a perspective view showing the outer appearance of the outer partition wall 642. An outer surface 646 of the outer partition wall 642 is the outer surface of the first partition wall 640. The outer surface 646 of the outer partition wall 642 is joined to the inner wall 606 of the body portion 610 of the exhaust muffler 500 by welding.

A contact surface 644 of the inner partition wall 641 comes in contact with a contact surface 645 of the outer partition wall 642. The contact surface 644 and the contact surface 645 are not joined and are slidable with respect to one another when in contact. The inner partition wall 641 and the outer partition wall 642 are slidably fitted when the contact surface 645 and the contact surface 644 are in contact. As a result, it is possible to improve the assemblability of the catalyst device 700 inside the exhaust muffler 500. In addition, even when the catalyst device 700 changes in axial length due to the influence of heat, it is possible for the inner partition wall 641 to support the catalyst device 700 while sliding with respect to the outer partition wall 642.

The contact surface 644 and the contact surface 645 are cylindrical surfaces centered around the axis L2. As shown in FIG. 6, the centers of the cylinders of the contact surface 644 and the contact surface 645 coincide with the axis L1 or are located near the axis L1. For this reason, when the length of the catalyst device 700 changes in the direction along the axis L2, it is possible for the contact surface 644 and the contact surface 645 to slide smoothly.

The inner partition wall 641 has a base portion 647 having an inner surface 643 joined to the catalyst device 700, a guide portion 648, and an outer peripheral portion 649 having the contact surface 644. The guide portion 648 is a portion between the base portion 647 and the outer peripheral portion 649. The guide portion 648 has a tapered shape that tapers toward the front.

As shown in FIG. 6, a first member 101 and a second member 102 of the exhaust pipe 10 and the front wall 612 of the exhaust muffler 500 are joined by a weld bead 104. The second member 102 is joined to the front end of the body portion 710 of the catalyst device 700. When assembling the exhaust muffler 500, the catalyst device 700 is inserted into the body portion 610 of the exhaust muffler 500 in a state where the peripheral wall 613 of the front wall 612 and the second member 102 are integrated by welding. At this time, the outer partition wall 642 joined to the exhaust muffler 500 is guided by the guide portion 648, the contact surface 645 and the contact surface 644 come in contact with one another, and the outer partition wall 642 is fitted with the inner partition wall 641. As a result, it is possible to easily assemble the exhaust muffler 500.

It is noted that the communication hole 651 and the communication hole 652 are formed through the outer partition wall 642. The front gas chamber 620 communicates with the rear gas chamber 622 through the communication hole 651 and the communication hole 652. As a result, it is possible to allow exhaust gas to enter and exit between the front gas chamber 620 and the rear gas chamber 622. It is noted that the communication hole 651 and the communication hole 652 may be formed through the inner partition wall 641.

As described above, the exhaust muffler structure shown in the present embodiment includes therein the catalyst device 700 having the catalyst 780 that purifies the exhaust gas of the engine 8, and has a structure connected to the exhaust pipe 10 that guides the exhaust gas from the engine 8 to the exhaust muffler 500. One end of the catalyst device 700 is connected to the exhaust pipe 10 and supported inside the exhaust muffler 500 via the exhaust pipe 10, and the body portion 710 of the catalyst device 700 is supported by the first partition wall 640 having the inner partition wall 641 and the outer partition wall 642 that is on the outer side of the inner partition wall 641. The outer partition wall 642 is fixed to the inner wall 606 of the exhaust muffler 500, and the inner partition wall 641 is fixed to the outer wall 704 of the catalyst device 700.

As a result, the exhaust muffler structure shown in the present embodiment has a structure in which the catalyst device 700 can be supported at both ends inside the exhaust muffler 500. When assembling the exhaust muffler 500, it is possible to assemble it in a state where the inner partition wall 641 is fixed to the catalyst device 700 and the outer partition wall 642 is fixed to the body portion 610 of the exhaust muffler 500. For this reason, it is possible to improve the assemblability and to stably hold the catalyst device 700. As a result, it is possible to improve the durability of the exhaust muffler 500 as a whole.

The outer partition wall 642 and the inner partition wall 641 respectively have the cylindrical contact surface 644 and the contact surface 645 that come in contact with one another, and are provided such that they are slidably fitted to one another. In particular, when a metal catalyst having a catalyst supported on a metal carrier is used as the catalyst 780, the expansion rate of the catalyst device 700 becomes relatively large depending on the temperature. According to the exhaust muffler structure shown in the present embodiment, the extension of the axis direction of the catalyst device 700 due to thermal expansion can be absorbed by the sliding of the contact surface 644 and the contact surface 645. For this reason, the support stability and the durability of the catalyst device 700 can be further improved.

The exhaust muffler 500 has a cylindrical shape in which the length of the axis L1 is longer than its diameter, and the front and rear ends of the catalyst device 700 are attached at a predetermined distance from the inner wall 606 of the exhaust muffler 500. As a result, it is possible to make it difficult for the heat of the catalyst device 700 to be transmitted to the exhaust muffler 500 while stably supporting the catalyst device 700 inside the exhaust muffler 500. As a result, it is possible to improve the heat resistance of the exhaust muffler 500. In addition, it is possible to prevent the temperature of the body portion 610 of the exhaust muffler 500 from becoming too high, and to easily take measures against heat for the passenger and the straddle type vehicle 100. In addition, it is possible to suppress the generation of sound due to rattling of the outer plate of the body portion 610 of the exhaust muffler 500.

The catalyst device 700 is supported inside the exhaust muffler 500 by the first partition wall 640 such that the axis L2 of the catalyst device 700 is inclined with respect to the axis L1 of the exhaust muffler 500. In addition, the throttle cylinder portion 714 is provided at the rear end of the catalyst device 700, and the throttle cylinder portion 714 overlaps in the axis L1 direction of the exhaust muffler 500 with the communication pipe 662 that is provided through the second partition wall 660 that partitions the inside of the exhaust muffler 500 into the rear first gas chamber 624 and the rear second gas chamber 626. Specifically, as shown in FIG. 5, when viewed along the axis L1, the rear end of the throttle cylinder portion 714 is positioned further to the rear than the front end of the communication pipe 662.

According to this exhaust muffler structure, by inclining the axis L2 of the catalyst device 700 with respect to the axis L1 of the exhaust muffler 500, it is possible to increase the distance between the rear end of the catalyst device 700 and the second partition wall 660 while securing the length of the catalyst device 700. In addition, it is possible to provide a structure in which the exhaust gas turns back into a plurality of flows. For this reason, it is possible to suppress the increase in size of the exhaust muffler 500. In addition, it is possible to improve the silencing effect while reducing the exhaust resistance. In addition, by inclining the axis L2 of the catalyst device 700 with respect to the axis L1 of the exhaust muffler 500, it is possible to adjust the position where the rear end of the catalyst device 700 comes near the body portion 610 of the exhaust muffler 500. By inclining the catalyst device 700 such that the position where the rear end of the catalyst device 700 comes near the body portion 610 of the exhaust muffler 500 is distanced from the rear wheels 3, it is possible to take measures against heat of the straddle type vehicle 100.

The contact surface 644 and the contact surface 645 are formed centered around the inclined axis passing through the center of the exhaust muffler 500. As a result, in comparison to when the center axis of the fitting surface of the contact surfaces are provided leaning inward or outward, it is possible to form the inner partition wall 641 and the outer partition wall 642 more evenly and widely. For this reason, since it is possible to form the region where the contact surface 644 and the contact surface 645 slide and fit to be sufficiently wide, the durability of the first partition wall 640 can be improved.

The enlarged cylinder portion 712 that connects the exhaust pipe 10 and the catalyst device 700 is connected to the upstream side of the catalyst device 700, and the enlarged cylinder portion 712 is a component having the same shape as the throttle cylinder portion 714. As a result, it is possible to share the parts that form the catalyst device 700. For this reason, it is possible to improve the productivity and to reduce manufacturing costs.

The communication hole 651 and the communication hole 652 are formed through the outer partition wall 642. As a result, it is possible for the exhaust gas to flow back and forth between the front gas chamber 620 and the rear gas chamber 622 that are partitioned by the first partition wall 640. For this reason, it is possible to improve the silencing effect. It is noted that the communication holes may be formed through at least one of the inner partition wall 641 and the outer partition wall 642.

As shown in FIG. 5 and the like, in a state where the exhaust muffler 500 is installed on the straddle type vehicle 100, the communication hole 651 and the communication hole 652 are positioned on the lower side and the inner side of the exhaust muffler 500. Specifically, the communication hole 651 and the communication hole 652 are at least positioned on the lower side of the axis L1 of the exhaust muffler 500 and on the inner side of the inner wall 606 of the muffler body 602. For this reason, since high temperature exhaust gas passes under the exhaust muffler 500 when going back and forth between the rear first gas chamber 624 and the front gas chamber 620, it is possible to improve the drainage property of water droplets accumulated on the lower portion inside the exhaust muffler 500. In addition, since the portion where the exhaust muffler 500 becomes hot due to the high temperature exhaust gas is positioned closer toward the inner side, it is possible to reduce the size of the muffler cover 510 for blocking heat from the exhaust muffler 500.

The exhaust pipe 10 is integral with the front wall 612 including the peripheral wall 613 that covers the upstream side of the exhaust muffler 500 and is also integral with the inner partition wall 641. The inner partition wall 641 is provided with a tapered guide portion 648. As a result, among the steps of assembling the catalyst device 700 inside the exhaust muffler 500, it is possible to perform the step of fitting the inner partition wall 641 and the outer partition wall 642 while fitting the peripheral wall 613 and the front end of the body portion 610 of the exhaust muffler 500 efficiently. For this reason, it is possible to improve the productivity of the exhaust muffler 500. The length of the guide portion 648 in the axis L2 direction is preferably longer than the length of the contact surface 645 of the outer partition wall 642 in the axis L2 direction. As a result, it is possible to improve the assemblability when assembling the catalyst device 700 in the exhaust muffler 500.

The exhaust pipe 10 is formed by the first member 101 and the second member 102, and the peripheral wall 613, the first member 101, and the second member 102 are integrated by the weld bead 104. As a result, it is possible to make the portion integrated by welding into a substantially linear form while improving the degree of freedom at which the exhaust pipe 10 bends. As a result, it is possible to improve the weldability. Therefore, it is possible to improve the reliability and productivity.

As described above, according to the exhaust muffler structure shown in the present embodiment, it is possible to improve the assemblability of the exhaust muffler while stably supporting the catalyst device 700 inside the exhaust muffler 500.

A four-wheel straddle type vehicle classified as an ATV is described above. However, the exhaust muffler structure relating to the exhaust muffler 500 may be applied to a straddle type vehicle other than an ATV. In addition, the exhaust muffler structure relating to the exhaust muffler 500 may be applied to a three-wheel straddle type vehicle or a two-wheel straddle type vehicle such as a motorcycle.

While the embodiments of the present invention have been described, the technical scope of the invention is not limited to the above described embodiments. It is apparent to persons skilled in the art that various alterations and improvements can be added to the above-described embodiments. In addition, the matters described in the specific embodiment can be applied to other embodiments within a technically consistent range. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCE SYMBOLS

2 Front wheel
3 Rear wheel
4 Vehicle body frame
5 Passenger seat
6 Front suspension
8 Engine
9 Case
10 Exhaust pipe
11 Steering shaft
13 Steering handlebar
14 Fuel tank
41 Upper pipe
42 Lower pipe
43 Rear pipe
51 Vehicle body cover
52 Front fender
53 Front protector
55 Rear fender
56 Rear carrier
100 Straddle type vehicle
101 First member
102 Second member
104 Weld bead
410 Upper inclined portion
412 Rear inclined portion
424 Lower horizontal portion
426 Rear inclined portion
432 Pipe stay
434 Collar
500 Exhaust muffler
510 Muffler cover
512 Band
520 Muffler stay
522 Muffler stay
530 Cushioning
535 Fastening member
602 Muffler body
606 Inner wall
610 Body portion
612 Front wall
613 Peripheral wall
614 Rear wall
615 Exhaust pipe
620 Front gas chamber
622 Rear gas chamber
624 Rear first gas chamber
626 Rear second gas chamber
628 Wave-like portion
630 Partition wall
640 Partition wall
641 Inner partition wall
642 Outer partition wall
643 Inner surface
644 Contact surface
645 Contact surface
646 Outer surface
647 Base portion
648 Guide portion
649 Outer peripheral portion
651, 652 Communication hole
660 Partition wall
662 Communication pipe
700 Catalyst device
704 Outer wall
710 Body portion
712 Enlarged cylinder portion
714 Throttle cylinder portion
780 Catalyst

What is claimed is:

1. An exhaust muffler structure to which an exhaust pipe for guiding exhaust gas from an engine to an exhaust muffler is connected, the exhaust muffler structure comprising:

a catalyst device, included inside the exhaust muffler structure, having a catalyst for purifying the exhaust gas of the engine, wherein the catalyst device has one end connected to the exhaust pipe and is supported inside the exhaust muffler via the exhaust pipe, and a body portion of the catalyst device is supported by a first partition wall having an inner partition wall and an outer partition wall that is on an outer side of the inner partition wall, the outer partition wall is fixed to an inner wall of the exhaust muffler, and the inner partition wall is fixed to an outer wall of the catalyst device, and the outer partition wall and the inner partition wall respectively have cylindrical contact surfaces that come in contact with one another, and the outer partition wall and the inner partition wall are provided slidably with respect to one another.

2. The exhaust muffler structure according to claim 1, wherein the catalyst is a metal catalyst that is supported on a metallic carrier.

3. The exhaust muffler structure according to claim 2, wherein the exhaust muffler has a cylindrical shape whose axis is longer than a diameter of the exhaust muffler, and front and rear ends of the catalyst device are attached at a predetermined distance from the inner wall of the exhaust muffler.

4. The exhaust muffler structure according to claim 3, wherein the catalyst device is supported inside the exhaust muffler by the first partition wall such that the axis of the catalyst device is inclined with respect to the axis of the exhaust muffler, a throttle-shaped cylinder portion is provided on the rear end of the catalyst device, and the throttle cylinder portion overlaps in the axis direction of the exhaust muffler with a communication pipe that is provided through a second partition wall that partitions the inside of the exhaust muffler into a plurality of gas chambers.

5. The exhaust muffler structure according to claim 4, wherein the contact surfaces are formed centered around an inclined axis that passes through the center of the exhaust muffler.

6. The exhaust muffler structure according to claim 4, wherein an enlarged cylinder portion that connects the exhaust pipe and the catalyst device and is enlarged from the exhaust pipe toward the catalyst device is connected on an upstream side of the catalyst device, and the enlarged cylinder portion is a part having a same shape as the throttle cylinder portion.

7. The exhaust muffler structure according to claim 1, wherein a communication hole is formed through at least one of the inner partition wall and the outer partition wall.

8. The exhaust muffler structure according to claim 7, wherein in a state where the exhaust muffler is installed on a vehicle, the communication hole is positioned on a lower side and the inner side of the exhaust muffler.

9. The exhaust muffler structure according to claim 1, wherein the exhaust pipe is integral with a front wall comprising a peripheral wall that covers an upstream side of the exhaust muffler and is integral with the inner partition wall, and the inner partition wall is provided with a tapered guide portion.

10. The exhaust muffler structure according to claim 9, wherein the exhaust pipe is formed by a first member and a second member, and the peripheral wall, the first member, and the second member are integrated by a weld bead.

* * * * *